US007150480B2

(12) United States Patent
Lafrenz

(10) Patent No.: US 7,150,480 B2
(45) Date of Patent: Dec. 19, 2006

(54) APPLIANCE LID LOCK AND METHOD FOR USING SAME

(75) Inventor: Michael D. Lafrenz, Newton, IA (US)

(73) Assignee: Maytag Corporation, Newton, IA (US)

( * ) Notice: Subject to any disclaimer, the term of this patent is extended or adjusted under 35 U.S.C. 154(b) by 393 days.

(21) Appl. No.: 10/391,264

(22) Filed: Mar. 17, 2003

(65) Prior Publication Data

US 2004/0195844 A1 Oct. 7, 2004

(51) Int. Cl.
*E05C 3/00* (2006.01)
*E05B 47/00* (2006.01)

(52) U.S. Cl. ..... 292/201; 292/216; 292/DIG. 11; 292/DIG. 69; 70/279.1

(58) Field of Classification Search ..... 292/201, 292/DIG. 11, DIG. 69, 216, DIG. 23; 70/279.1, 70/280–282
See application file for complete search history.

(56) References Cited

U.S. PATENT DOCUMENTS 2,314,332 A * 3/1943 Ferris ..... 134/57 DL
2,882,360 A * 4/1959 Sisson ..... 200/61.7
2,910,317 A * 10/1959 Conlee ..... 292/64
2,936,892 A * 5/1960 McNeil et al. ..... 210/146
3,546,410 A 12/1970 Brighenti
3,569,646 A * 3/1971 Smith ..... 200/61.68
3,627,960 A * 12/1971 Grabek ..... 200/61.64
3,750,643 A * 8/1973 Fowler et al. ..... 126/197
3,784,776 A * 1/1974 Asanuma ..... 219/724
3,850,185 A * 11/1974 Guth ..... 134/58 DL
3,857,002 A 12/1974 Lay et al.
4,032,180 A * 6/1977 Pohl ..... 292/341.16
4,262,945 A * 4/1981 Paulson ..... 292/89
4,342,476 A 8/1982 Brown et al.
4,509,779 A * 4/1985 Sasaki ..... 292/254
4,510,777 A * 4/1985 Ellingson et al. ..... 68/12.26
4,623,179 A 11/1986 Davis et al.
4,718,705 A * 1/1988 Case ..... 292/201
4,926,664 A * 5/1990 Gartner et al. ..... 70/119
4,927,996 A * 5/1990 Genbauffe et al. ..... 219/413
4,988,132 A * 1/1991 Rocchitelli ..... 292/144
4,995,650 A * 2/1991 Schantz et al. ..... 292/201
5,012,794 A * 5/1991 Faurel ..... 126/197
5,038,587 A 8/1991 Harmelink
5,323,628 A * 6/1994 Mori et al. ..... 68/12.26
5,520,424 A * 5/1996 Hapke et al. ..... 292/198
5,600,976 A * 2/1997 Hapke et al. ..... 68/12.26
5,639,130 A * 6/1997 Rogers et al. ..... 292/216
5,728,985 A * 3/1998 Hapke et al. ..... 200/61.62
5,742,964 A 4/1998 Choi (Continued)

FOREIGN PATENT DOCUMENTS

JP 403143498 A 6/1991

*Primary Examiner*—Brian E. Glessner
*Assistant Examiner*—Carlos Lugo
(74) *Attorney, Agent, or Firm*—McKee, Voorhees & Sease, P.L.C.

(57) ABSTRACT

An appliance lid lock includes a sensing circuit which senses the position of the lid lock relative to the appliance lid. When the appliance lid is in its closed position and the lid lock retentively engages the appliance lid, a controller causes activation of the appliance driver. When the appliance lid is not in its closed position and the lid lock moves beyond its locked position to a third position, a sensing circuit causes the controller to maintain all the appliance drivers in a deactivated state and to return the lid lock to its original unlocked position.

11 Claims, 7 Drawing Sheets

U.S. PATENT DOCUMENTS 5,823,017 A * 10/1998 Hapke et al. ..... 68/12.26
5,938,252 A * 8/1999 Uemura et al. ..... 292/201
6,082,787 A 7/2000 Chioffi et al.
6,302,098 B1 * 10/2001 Smith ..... 126/197
6,315,336 B1 * 11/2001 Swartzell ..... 292/201
6,363,755 B1 * 4/2002 Hapke et al. ..... 68/12.26
6,557,911 B1 * 5/2003 Nelsen et al. ..... 292/216
6,634,684 B1 * 10/2003 Spiessl ..... 292/341.16
6,659,515 B1 * 12/2003 Raymond et al. ..... 292/201
6,698,418 B1 * 3/2004 Ramsey et al. ..... 126/197

* cited by examiner

APPLIANCE LID LOCK AND METHOD FOR USING SAME

BACKGROUND OF THE INVENTION

The present invention relates to an appliance lid lock and method for using same.

Many appliances include an access opening and a lid moveable from an open position to a closed position in covering relation over the access opening.

Lid locks have been provided for retentively engaging the lid in its closed position so as to lock it against being opened during the time that the appliance is operating. It is desirable from a safety standpoint to prevent the actuation of the appliance drive system at all times except when the lid is in its closed or locked position.

Therefore a primary object of the present invention is the provision of an improved appliance lid lock and method for using same.

A further object of the present invention is the provision of an appliance lid lock that prevents actuation of the appliance drive except when the appliance lid is closed and in its locked position.

A further object of the present invention is the provision of an appliance lid lock and method for using same which prevents the actuation of the drive mechanism whenever the lid is in an open position or in any position other than its closed and locked position.

A further object of the present invention is the provision of an appliance lid lock and method for using same which senses the position of the lid so as to permit the actuation of the appliance drive mechanism only when the lid is in its closed and locked position.

A further object of the present invention is the provision of an appliance lid lock and method for using same which is economical to manufacture, durable in use and efficient in operation.

BRIEF SUMMARY OF THE INVENTION

The foregoing objects may be achieved with a lid lock for an appliance comprising an appliance driver adapted to be activated when electrical power is introduced to the appliance driver and adapted to be deactivated when electrical power is shut off from the appliance driver. A lock member is moveably mounted for sequential movement from an unlock position to a lock position to a third position. An electrical sensing circuit is associated with the lock member for creating first, second and third electrical signals corresponding to sensing when the lock member is in the unlock, lock or third positions respectively. A controller is connected to the sensing circuit for receiving the first, second and third electrical signals. The controller is connected to the appliance driver for causing the appliance driver to become deactivated whenever the lock member is in the unlock and third positions and for causing the appliance driver to be activated whenever the lock member is in the lock position beyond a predetermined interval of time.

According to a further feature of the present invention the lock driver is connected to the lock member for moving the lock member between the unlock, lock and third positions and the controller is connected to the lock driver for causing the lock driver to move the lock member to the unlock, lock and third positions and for returning the lock member to the unlock position whenever the lock member is in its third position.

A further feature of the invention comprises an appliance cabinet having a lid opening therein and a lid mounted to the cabinet for movement from an open position to a closed position. The lock member engages and locks the lid when the lid is in its closed position and when the lock member is in its lock position.

According to another feature of the invention the lock member has a limit surface thereon engaging the lid when the lid is in its closed position and when the lock member is in its lock position so as to prevent the lock member from moving from the lock position to its third position.

According to a further feature of the invention the electrical sensing circuit comprises a moveable contact moveable in response to the sequential movement of the lock member from the unlock to the lock and to the third positions, and a fixed contact which engages the moveable contact only when the lock member is in its lock position.

According to another feature of the invention the controller keeps the appliance driver in a deactivated state when the moveable contact moves into an electrical contract with the fixed contact for a time interval less than the predetermined time interval.

According to another feature of the present invention the lid lock member is pivotably moveable from its unlock position to its lock position to its third position.

According to another feature of the present invention the lock driver comprises a solenoid.

The method of the present invention comprises sensing when the locking member is in the unlock position, the lock position, and the third position. The method further comprises returning the lid locking member to the unlock position whenever the locking member is sensed to be in the third position.

According to another feature of the method of the present invention the appliance includes an appliance driver adapted to be in an activated state or in a deactivated state. The method further comprises maintaining the appliance driver in the activated state only when the lid lock is in the lock position and maintaining the appliance driver in a deactivated state at all other times.

DETAILED DESCRIPTION OF THE INVENTION

Figure 1:
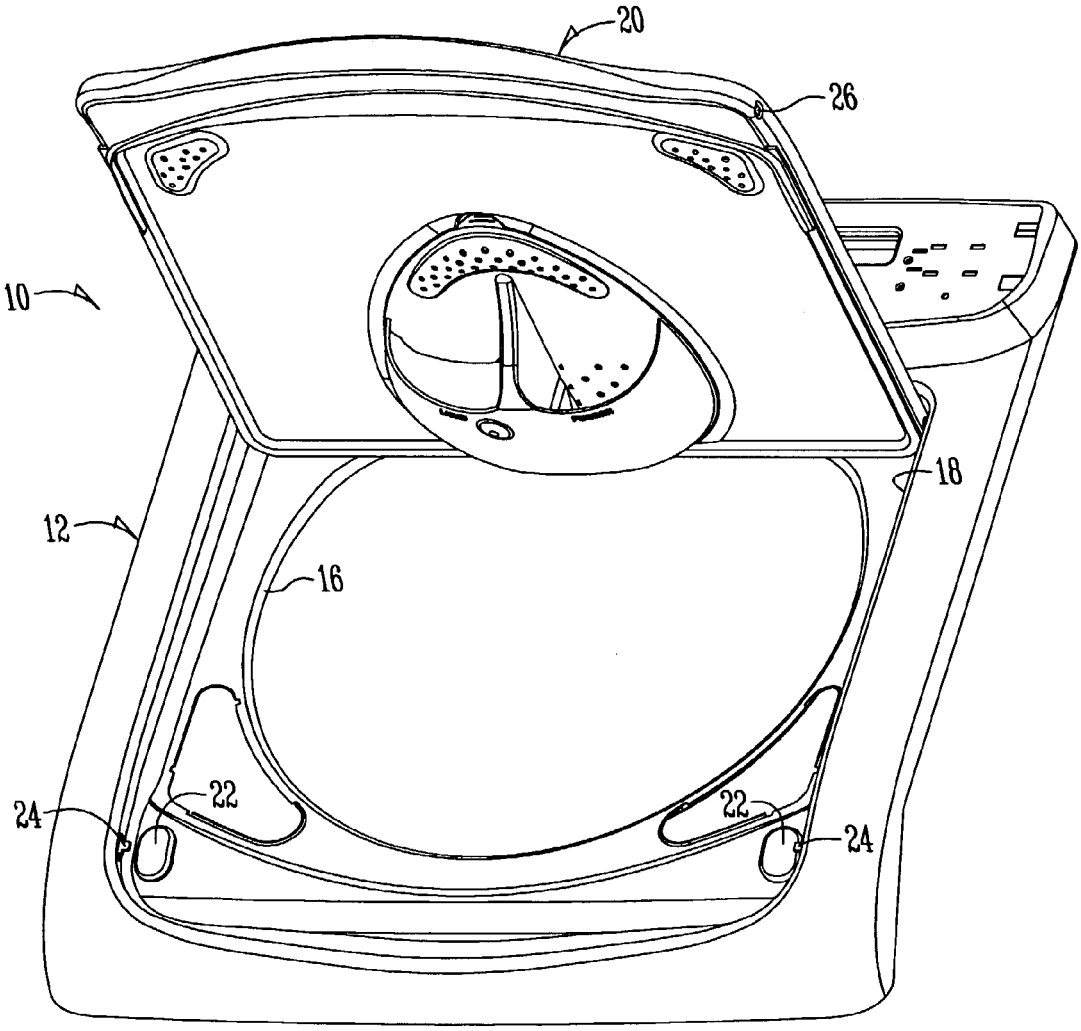
FIG. 1 is a pictorial view of an appliance cabinet top showing the lid in its open position.

Referring to FIG. 1 the numeral 10 generally designates an appliance of the present invention. Only the top cover 12 of the appliance 10 is shown but the appliance can include other cabinet portions, depending upon the particular type of appliance involved.

Figure 2:
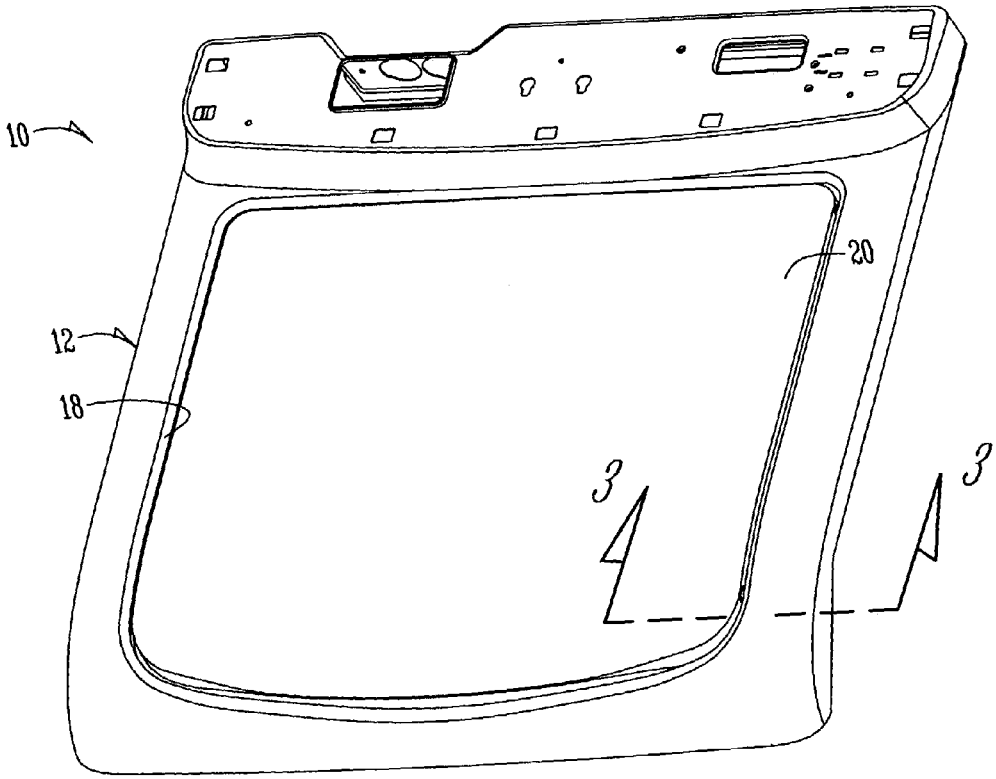
FIG. 2 is a view similar to FIG. 1 but showing the lid in the closed position.

Top cover 12 includes control panel (not shown) at its back edge and an access opening 16 for providing access into the interior of the appliance. A lid recess 18 extends around the access opening 16. A lid 20 is hinged at its rear edge to top cover 12 and folds from its open position shown in FIG. 1 to its closed position fitting within the recess 18 as shown in FIG. 2.

Figure 3:
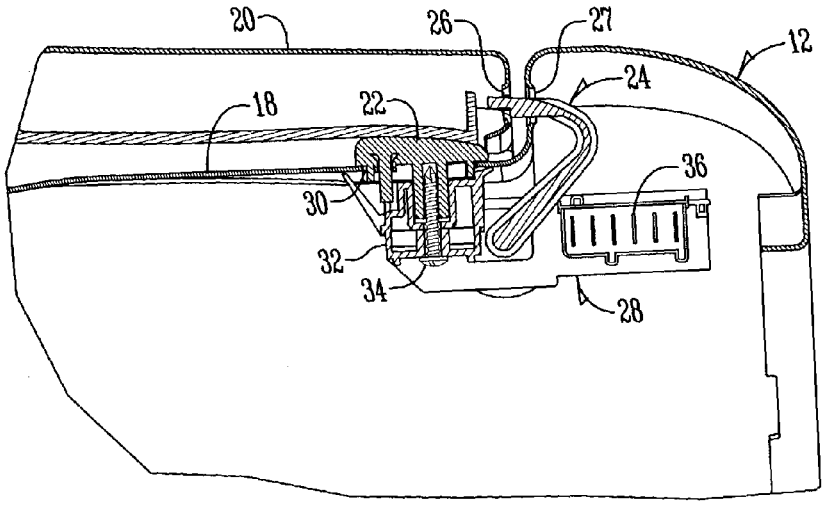
FIG. 3 is a sectional view taken along line 3—3 of FIG. 2.

Protruding upwardly within recess 18 are a pair of spaced apart lid pads 22, and protruding horizontally inwardly from the edge of lid recess 18 are a pair of lid locking members shown partially at 24 in FIG. 1. Lid locking members 24 are adapted to protrude into a lid lock hole 26 when the lid is in its closed position. As can be seen in FIG. 3 the lid locking member 24 protrudes through a top cover lock hole 27.

On the under surface of the top cover 12 is a lid lock assembly 28, and the lid pad 22 protrudes through a pad opening 30 in the top cover 12. A screw 34 attaches a lock housing 32 to the lid pad 22, and attaches the lid lock assembly 28 to the top cover 12.

The lid lock assembly 28 includes multiple electrical connectors 36 for connecting the various components to outside components as will be described more fully hereafter in the discussion of the electrical schematic of FIG. 11.

Figure 5:
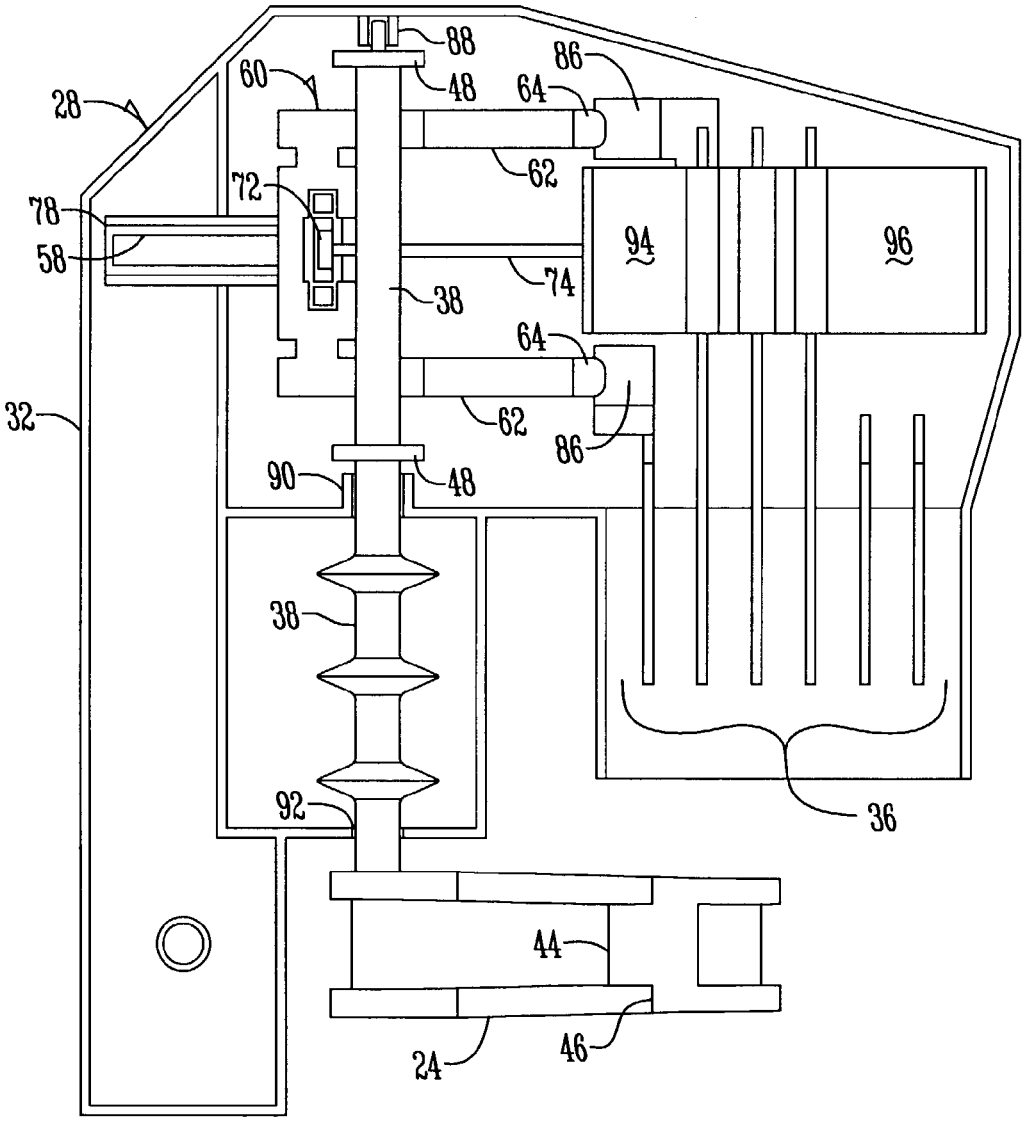
FIG. 5 is a top plan view of the lid lock assembly of the present invention.
Figure 6:
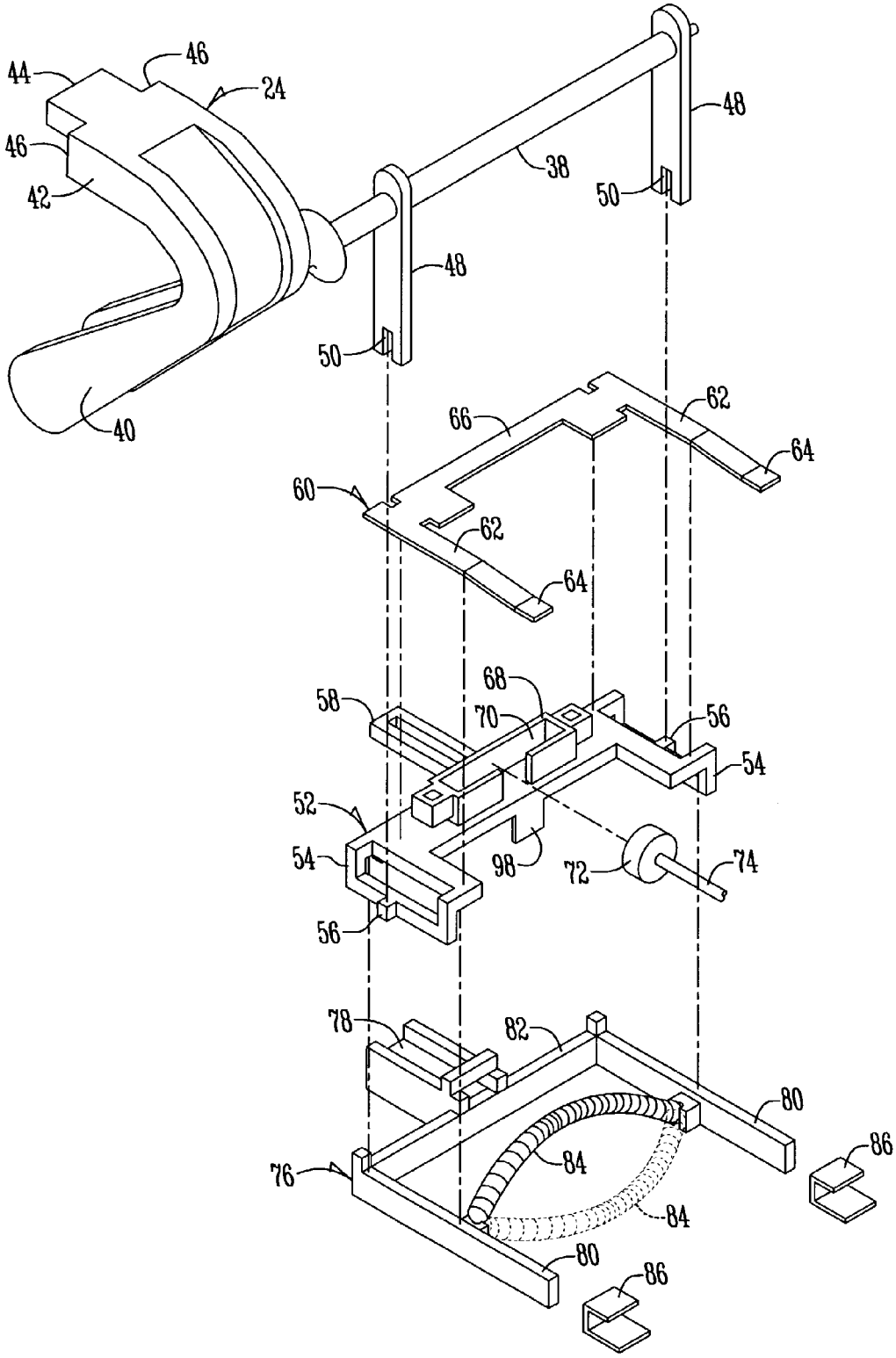
FIG. 6 is an exploded perspective view of the mechanism within the lid lock assembly.
Figure 7:
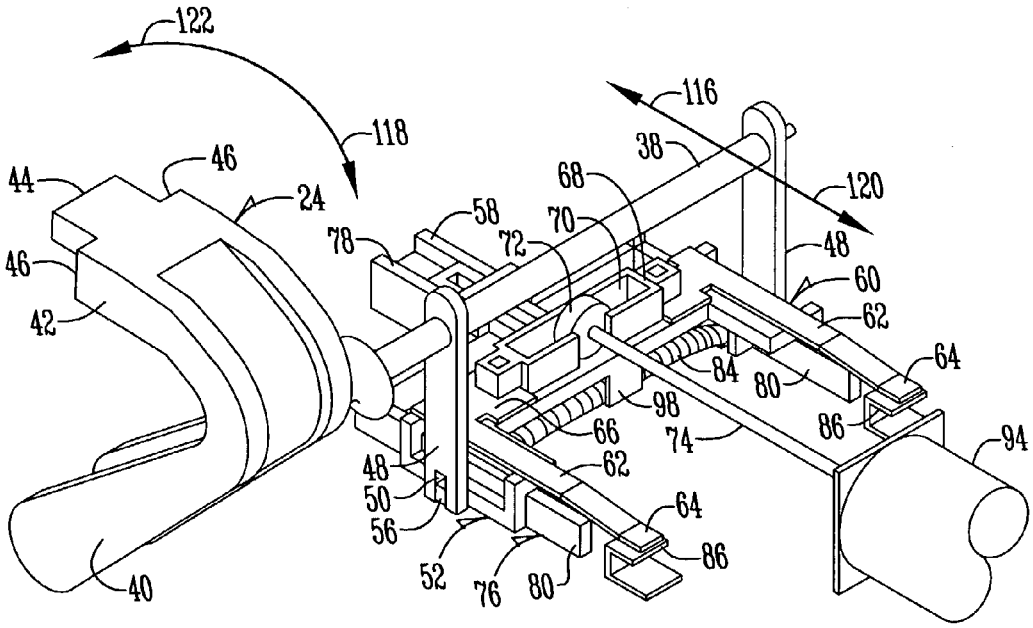
FIG. 7 is a perspective view of the mechanism in the lid lock assembly.

Referring to FIGS. 5, 6, and 7, the interior of the lid lock assembly 28 includes a lock member shaft 38 having the lid locking member 24 at one end thereof. Lid locking member 24 includes a shank portion 40 and a hook portion 42. At the tip of the hook portion 42 is a pawl 44, and adjacent the pawl 44 is a shoulder 46. At the opposite ends of the shaft 38 are a pair of spaced apart links 48 which are rigidly attached to the shaft 38 and which include notches 50 at their lower ends.

Notches 50 extend downwardly and retentively engage a pair of studs 56 which are on a sliding carriage 52. Sliding carriage 52 includes slide flanges 54. Protruding rearwardly from the slide carriage 52 is a slide guide 58.

A U-shaped moveable electrical contact 60 includes a pair of spaced apart control arms 62 having control contact tips 64 at their ends. Extending between the contact arms 62 is a contact web 66 which fits around and beneath a carriage superstructure 68 on the sliding carriage 52 so that the u-shaped contact 60 is attached to the sliding carriage 52. Superstructure 68 also includes a rod receptacle 70 which is adapted to receive a rod head 72 at the end of a rod shaft 74. Two opposite acting solenoids 94, 96, drive rod head 72 in a back and forth reciprocating movement.

Fixed to the bottom of the lid lock housing 32 is a carriage track 76 having a guide receptacle 78 for receiving slide guide 58 therein for sliding movement back and forth. Carriage track 76 also includes a pair of spaced apart side rails 80 about which the slide flanges 54 of sliding carriage 52 fit so that the carriage 52 is free to slide in reciprocating opposite directions on the side rails 80. Side rails 80 are joined by a cross member 82. Attached between the side rails 80 is a spring 84 which is bowed as shown in FIG. 6 so that it will flop from the position shown in bold lines in FIG. 6 to the position shown in shadow lines in FIG. 6. A unshaped spring holder 98 is provided on the carriage 52 for retentively fitting over the spring 84. Thus as the carriage 52 reciprocates back and forth it causes the spring 84 to move between the two positions shown in solid lines and shadow lines in FIG. 6.

A pair of fixed contacts 86 are mounted on the housing 32 of the lid lock assembly 28. Shaft 38 is rotatably received within three shaft cradles 88, 90, 92 so that the lock member 24 can pivot about the axis provided by the shaft 38.

In operation, the solenoids 94 and 96 are actuated one at a time to extend and retract the rod shaft 74. When the rod shaft 74 is extended it moves the carriage 52 to its outer most position indicated by the arrow 116. This causes the lid locking member to rotate in a clockwise direction as indicated by the arrow 118 in FIG. 7. The solenoid 94 is only activated for a short time to move the carriage 52 to its outermost position. After solenoid 94 is deactivated, the bowed spring 84 yieldably urges the carriage 52 toward its outermost position.

Activation of the other solenoid 96 causes retraction of the shaft 74 and causes the slide 52 to move in the direction indicated by the arrow 120 in FIG. 7. Correspondingly the lid locking member 24 rotates in a counterclockwise direction as indicated by arrow 122, and bowed spring 84 assumes the position in shadow lines in FIG. 6, so as to urge carriage 52 in the opposite direction.

Figure 8:
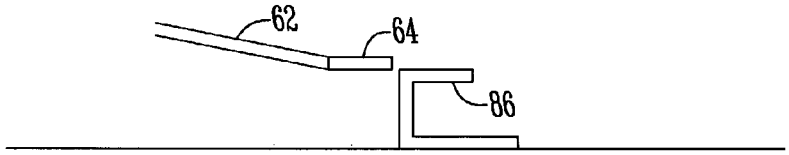
FIGS. 8, 9, and 10 are views showing the three positions showing the moveable contact relative to the fixed contact of the present invention.
Figure 9:
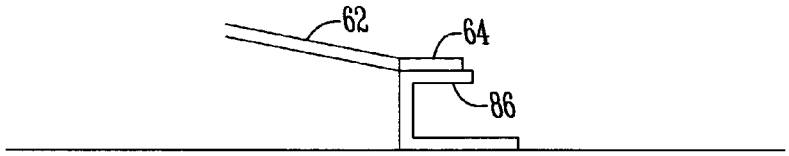
Figure 10:
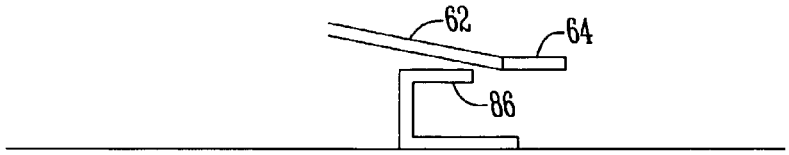

FIGS. 8, 9, and 10 illustrate the three positions of the moveable contacts 64 relative to the fixed contacts 86. In the initial position with the shaft 74 in its extended position, the moveable contact tips 64 are out of engagement with the fixed contacts 86. This represents an unlock position. In this position, the lid locking member 24 is in its unlock position shown in the upper portion of FIG. 4.

FIG. 9 illustrates the moveable contact tips 64 in electrical contact with the fixed contact 86. This position is the lock position corresponding to the middle portion of FIG. 4. In this lock position the shoulders 46 engage the lid 20 to prevent the lid locking member 24 from moving to its third position shown in FIG. 10. Spring 84 urges the carriage 52 to its fully retracted position indicated by arrow 120 (FIG. 7), but is prevented from doing so because shoulders 46 of locking member 24 engage the lid 20.

Figure 4:
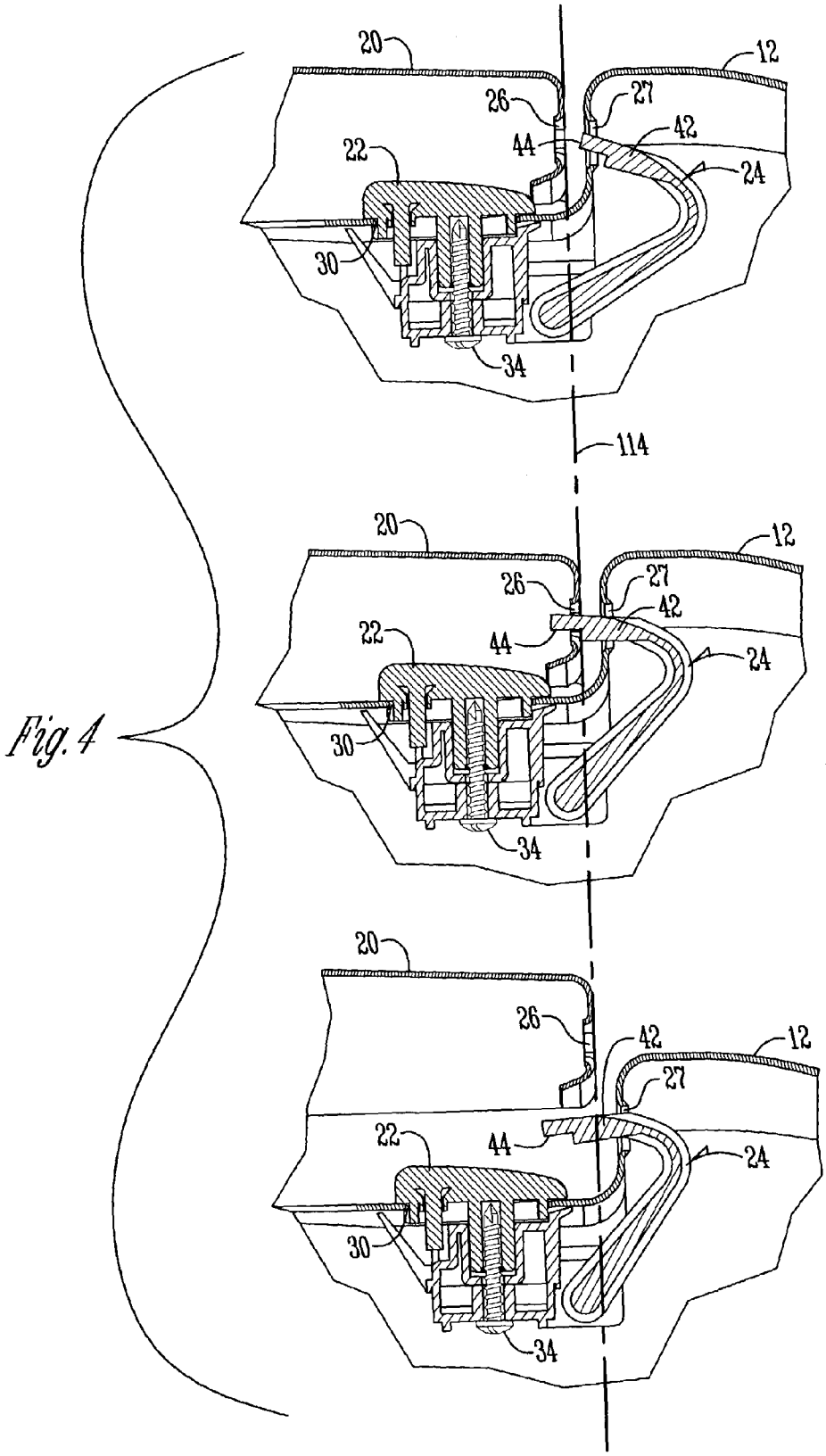
FIG. 4 is a sectional view similar to FIG. 3 showing along a vertical centerline 114 the three different positions for the lock member of the present invention.

If lid 20 is open or ajar as shown in the bottom of FIG. 4, the spring 84 causes locking member 24 to move to the position shown in the bottom of FIG. 4. In this position the movable contact tips 64 move out of contact with the fixed contacts 86 (FIG. 10) and this third position is shown at the bottom of FIG. 4.

Spring 84 plays an important function in the movement of the lid locking member 24 from its unlock position shown at the top of FIG. 4 to its lock position shown in the middle of FIG. 4 to its third position shown at the bottom of FIG. 4. The spring flips back and forth between the positions shown in solid lines in FIG. 6 and in the shadow lines of FIG. 6. When the spring is in the position shown in solid lines of FIG. 6 the lid lock 24 is in its unlock position shown at the top of FIG. 4. When the spring is in the position shown in shadow lines in FIG. 6 the lid locking member 24 is in the third position shown in the bottom of FIG. 4. Only if the lid 20 is in its closed position does the locking member 24 protrude within the lid lock hole 26 and the shoulder 46 engages the lid 20 to prevent the lid locking member 24 from moving from the lock position, shown in the center of FIG. 4, to the third position shown in the bottom of FIG. 4.

Figure 11:
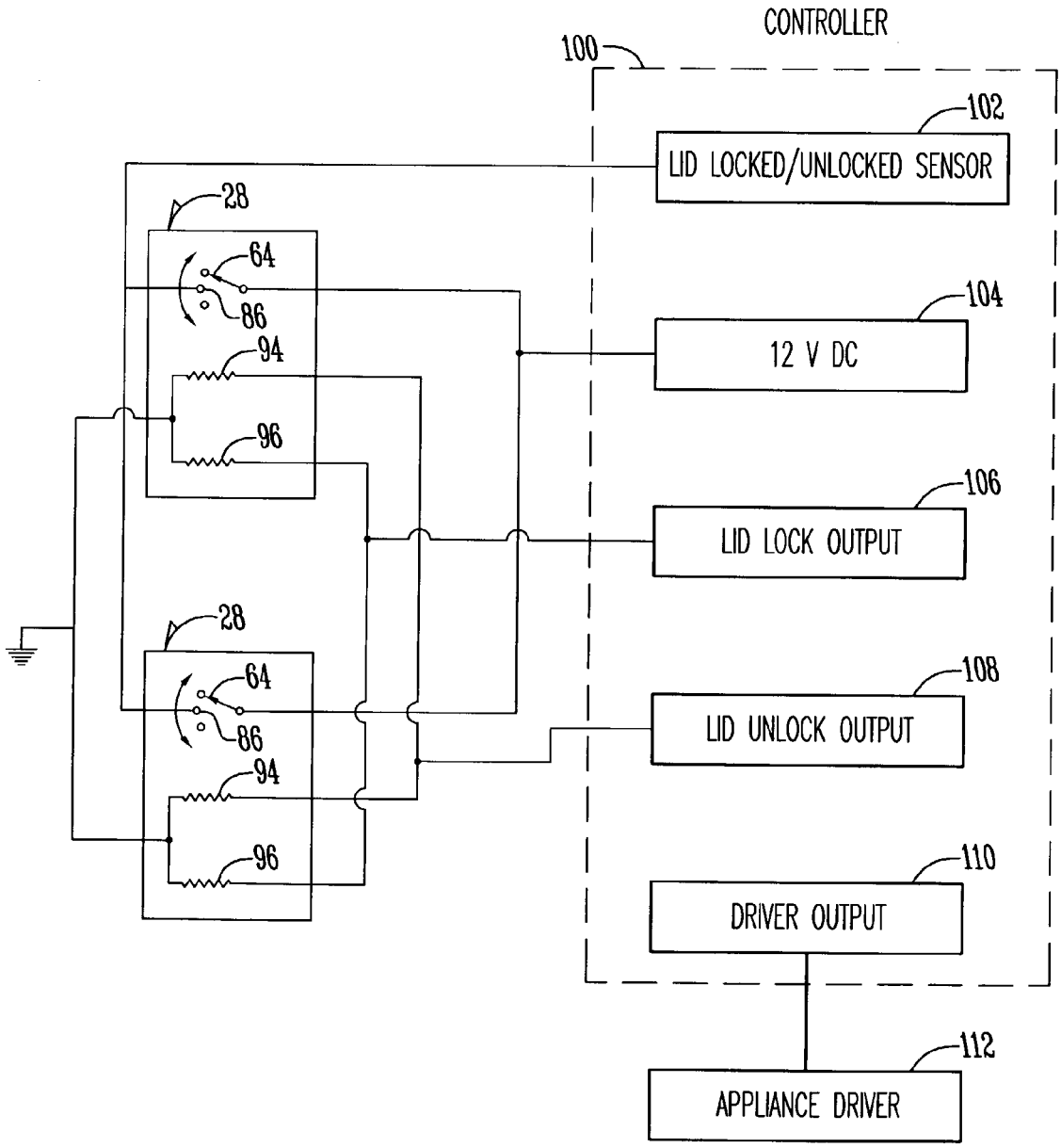
FIG. 11 is a schematic view of the present invention.

Referring now to the schematic shown in FIG. 11, a controller 100 includes a lid lock/unlock sensor 102 therein. Also within controller 100 is a power supply 104, a lid lock output 106, a lid unlock output 108, and an appliance driver output 110. The appliance output 110 is connected to an appliance driver 112.

In operation, the sensor 102 is connected to fixed contacts 86 at both of the two spaced apart lid lock assemblies 28. The lid lock sensor is adapted to sense when the moveable contacts 64 are in contact with the fixed contact 86, and are also adapted to sense when the moveable contacts 64 move past the fixed contacts 86 to the third position shown at the bottom of FIG. 4 and in FIG. 10

The controller 100 is adapted to actuate solenoid 96 to move the moveable contact 64 from its unlock position towards its lock position. If the lid 20 is in its closed position, the lock member 24 will move to the position shown in the middle of FIG. 4 and because of the engagement of shoulders 46 with the lid 20 will move no further. Sensor 102 senses when the lid locking member 24 is in this position beyond a predetermined interval of time, and causes the driver output to actuate to the appliance driver.

If the lid is open or slightly ajar as shown in the bottom FIG. 4, the spring 84 will cause the lid locking member 24 to move to the position in FIG. 10. As can be seen in FIG. 4, the lid locking member 24 has moved beyond its locked position shown in the middle of FIG. 4 to its third position shown at the bottom of FIG. 4. The lid lock unlock sensor 102 of the controller 100 senses that the moveable contacts 64 have only contacted the contacts 86 for a short time, and consequently does not actuate the driver output 110 or the appliance driver 112. Instead the controller 100 causes the lid unlock output 108 to be actuated to move the lid locking member 24 back to its initial unlock position shown at the top of FIG. 4. In the process of returning the lid locking member 24 to the initial unlock position, the lid lock unlock sensor 102 of the controller 100 again senses instantaneous contact between moveable contacts 64 and contacts 86. It is in this manner that controller 100 determines that the locking member was indeed in the third position.

If the lid lock hole 26 is only slightly misaligned from the locking member 24, the pawl 44 may contact the lid 20 at a point where the moveable contacts 64 make contact with the contact 86 for a short time, and subsequently the spring 84 urges the locking member 24 back to its initial unlock position as shown in the top of FIG. 4. The lid lock unlock sensor 102 will sense the instantaneous contact and the controller 100 will assume the contacts to be in the third position. The controller 100 causes the lid unlock output 108 to be actuated to move the lid locking member 24 back to its initial unlock position shown at the top of FIG. 4. Because the lid locking member 24 is already in the initial unlock position, the lid lock unlock sensor 102 will not sense any instantaneous contact between contact 86 and moveable contact 64. In this case, the controller 100 senses that the contacts 64 were never in the third position. The controller 100 can also turn on an indicator light on the control panel (not shown) indicating to the operator that the lid is in a misaligned position.

It is anticipated that another fixed contact could be utilized to provide definitive feedback to the controller 100 when the lock member 24 is in the third position. However, an assumption that the lock member 24 is in the third position whenever instantaneous contact is sensed, will most often be correct. The ability to verify the assumption via the lid lock unlock sensor 102 eliminates the extra expense of this contact, associated wiring, and the additional input to controller 100.

Thus when the lid 20 is in its closed position, the lid locking member 24 moves into locking retentive engagement with the lid 20 and the controller senses this position and actuates the appliance driver. When the lid 20 is ajar or is open, the lid locking member 24 moves over center to the third position shown at the bottom of FIG. 4, and the controller senses this and prevents any further actuation of the appliance driver. The controller can also turn on an indicator light on the control panel (not shown) indicating to the operator that the lid is in an unlocked position.

When the appliance driver completes its operational cycle the controller causes the lid unlock output 108 to actuate solenoid 94, to move the moveable contact back to its unlock position.

The purpose of the invention, i.e. the third position of the contact tips 64, is to eliminate the need for a separate switch to indicate the position of the lid. While it is common in the industry to utilize a separate lid switch, the value of this invention is the elimination of the lid switch, associated wiring, assembly labor and the inherent reduction of system reliability induced by another component. The provision of the third position of the contact tips 64 provides the function of a separate lid switch without added cost.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defines in the following claims.

What is claimed is:

1. A lid lock for an appliance lid comprising:

an appliance driver adapted to be activated when electrical power is introduced to the appliance driver and being adapted to be deactivated when electrical power is shut off from the appliance driver;

a lock member movably mounted for sequential movement from an unlock position free from engagement with the lid, to a lock position retentively engaging the lid when the lid is in a closed position, and to a third position;

an electrical sensing circuit associated with the lock member for creating first, second and third electrical signals corresponding to the unlock, lock and third positions, respectively;

a controller connected to the sensing circuit for interpreting the first, second and third electrical signals from the sensing circuit, the controller being connected to the appliance driver for causing the appliance driver to be deactivated whenever the lock member is in the unlock and third positions and for causing the appliance driver to be activated whenever the lock member is in the lock position beyond a predetermined interval of time; and the electrical sensing circuit comprising a movable contact movable in response to the sequential movement of the lock member from the unlock to the lock to the third positions, and a fixed contact which engages the movable contact only when the lock member is in the lock position.

2. A lid lock according to claim 1 and further comprising a lock driver connected to the lock member for moving the lock member between the unlock, lock and third positions, the controller being connected to the lock driver for causing the lock driver to move the lock member to the unlock, lock and third positions and for returning the lock member to the unlock position whenever the lock member is in the third position.

3. A lid lock according to claim 2 and further comprising an appliance cabinet having a lid opening therein, and a lid mounted to the cabinet for movement from an open position to a closed position, the lock member engaging and locking the lid when the lid is in the closed position and when the lock member is in the lock position.

4. A lid lock according to claim 1 wherein the controller keeps the appliance driver in a deactivated state when the movable contact moves into electrical contact with the fixed contact for a time interval less than the predetermined time interval.

5. A lid lock for an appliance comprising:

an appliance cabinet having an access opening therein;

a lid mounted to the appliance cabinet for movement from an open position permitting access into the appliance cabinet through the access opening to a closed position in covering relation over the access opening;

a lid lock member being sequentially movable from an unlock position free from engagement with the lid to a lock position retentively engaging the lid when the lid is in the closed position, to a third position different from the lock position and the unlock position;

a lock driver for moving the lid lock member between the unlock, lock, and third positions;

the lid engaging the lid lock member and preventing the lid lock member from moving to the third position whenever the lid is in the closed position;

a controller connected to the lock driver for selectively actuating the driver to move the lid lock member between the unlock, lock and third positions;

a sensing circuit connected to the lid lock member for signaling when the lid lock member is in the unlock, lock, and third positions respectively;

the controller being connected to the sensing circuit for causing the lock driver to move the lid lock member from the third position to the unlock position in response to a sensing circuit signal indicating that the lid lock member is in the third position.

6. A lid lock according to claim 5 and further comprising an appliance driver adapted to be activated within the cabinet, the controller being connected to the appliance driver and maintaining the appliance driver in a deactivated state when the lid lock member is in either the unlock or the third positions, and maintaining the appliance driver in an actuated state when the lid lock member is in the lock position.

7. A lid lock according to claim 6 wherein the sensing circuit includes a movable contact movable in response to the movement of the lid lock member to the unlock, lock, and third positions, and a fixed contact that is in electrical contact with the movable contact only when the lid lock member is in the lock position.

8. A lid lock for an appliance lid comprising:

an appliance driver adapted to be activated when electrical power is introduced to the appliance driver and being adapted to be deactivated when electrical power is shut off from the appliance driver;

a lock member movably mounted for sequential movement from an unlock position free from engagement with the lid, to a lock position retentively engaging the lid when the lid is in a closed position, and to a third position wherein a lock driver is connected to the lock member for moving the lock member between the lock, unlock and third position;

an electrical sensing circuit associated with the lock member for creating first, second and third electrical signals corresponding to when the lock member is in the lock, unlock and third positions, respectively;

a controller connected to the sensing circuit for interpreting the first, second and third electrical signals from the sensing circuit, the controller being connected to the appliance driver for causing the appliance driver to be deactivated whenever the lock member is in the unlock and third positions and for causing the appliance driver to be activated whenever the lock member is in the lock position beyond a predetermined interval of time wherein the controller is further connected to the lock driver for causing the lock driver to move the lock member to the lock, unlock and third positions and for returning the lock member to the unlock position whenever the lock member is in the third position.

9. A lid lock according to claim 8 and further comprising an appliance cabinet having a lid opening therein, and a lid mounted to the cabinet for movement from an open position to a closed position, the lock member engaging and locking the lid when the lid is in the closed position and when the lock member is in the lock position.

10. A lid lock according to claim 8 wherein the electrical sensing circuit comprises a movable contact movable in response to the sequential movement of the lock member from the unlock to the lock to the third positions, and a fixed contact which engages the movable contact only when the lock member is in the lock position.

11. A lid lock according to claim 10 wherein the controller keeps the appliance driver in a deactivated state when the movable contact moves into electrical contact with the fixed contact for a time interval less than the predetermined time interval.

* * * * *